United States Patent [19]

Grasse

[11] Patent Number: 4,669,784

[45] Date of Patent: Jun. 2, 1987

[54] OSCILLATED HEAD AND CONNECTING ELEMENT, WITH BEARING SUPPORT, FOR FLOOR STRIPPING MACHINE

[75] Inventor: Palmer Grasse, Glendale, Calif.

[73] Assignee: Palmer Grasse, Glendale, Calif.

[21] Appl. No.: 832,217

[22] Filed: Feb. 24, 1986

[51] Int. Cl.[4] ..... A47L 11/12; A47L 13/02

[52] U.S. Cl. ..... 299/37; 15/93 R

[58] Field of Search ..... 299/37; 15/93 R; 30/169

[56] References Cited

U.S. PATENT DOCUMENTS

| | | | |
|---|---|---|---|
| 3,376,071 | 4/1968 | Stein | 299/37 |
| 3,770,322 | 11/1973 | Cobb et al. | 299/37 |
| 4,365,842 | 12/1982 | Grasse | 299/37 |
| 4,365,843 | 12/1982 | Grasse | 299/37 |
| 4,452,492 | 6/1984 | Grasse | 299/37 |
| 4,483,566 | 11/1984 | Grasse | 299/37 |
| 4,504,093 | 3/1985 | Grasse | 299/37 |
| 4,512,611 | 4/1985 | Grasse | 299/37 |

*Primary Examiner*—Stephen J. Novosad
*Assistant Examiner*—Michael A. Goodwin
*Attorney, Agent, or Firm*—William W. Haefliger

[57] ABSTRACT

Apparatus usable in power-operated floor stripping apparatus that includes a frame, a drive carried on the frame, wheels supporting the frame, a handle to guide the frame, and a cutting blade carried by a head which is pivotally mounted to the frame, the apparatus comprising a lightweight rugged connecting element having a first tubular part and a second tubular part, those parts having spaced, parallel axes, the second tubular part pivotally connected to the head. The connecting element includes two parallel and spaced legs extending between the first and second tubular parts and integrally merging with the sides thereof at locations spaced from the opposite ends thereof. First webs on each leg have edges tangent with the tubular parts, and they define planes intersecting thickened lugs on the head, and also eccentrics on a drive shaft. Second webs on the legs intersect the first web at enlarged areas of the legs.

12 Claims, 17 Drawing Figures

FIG. 13.
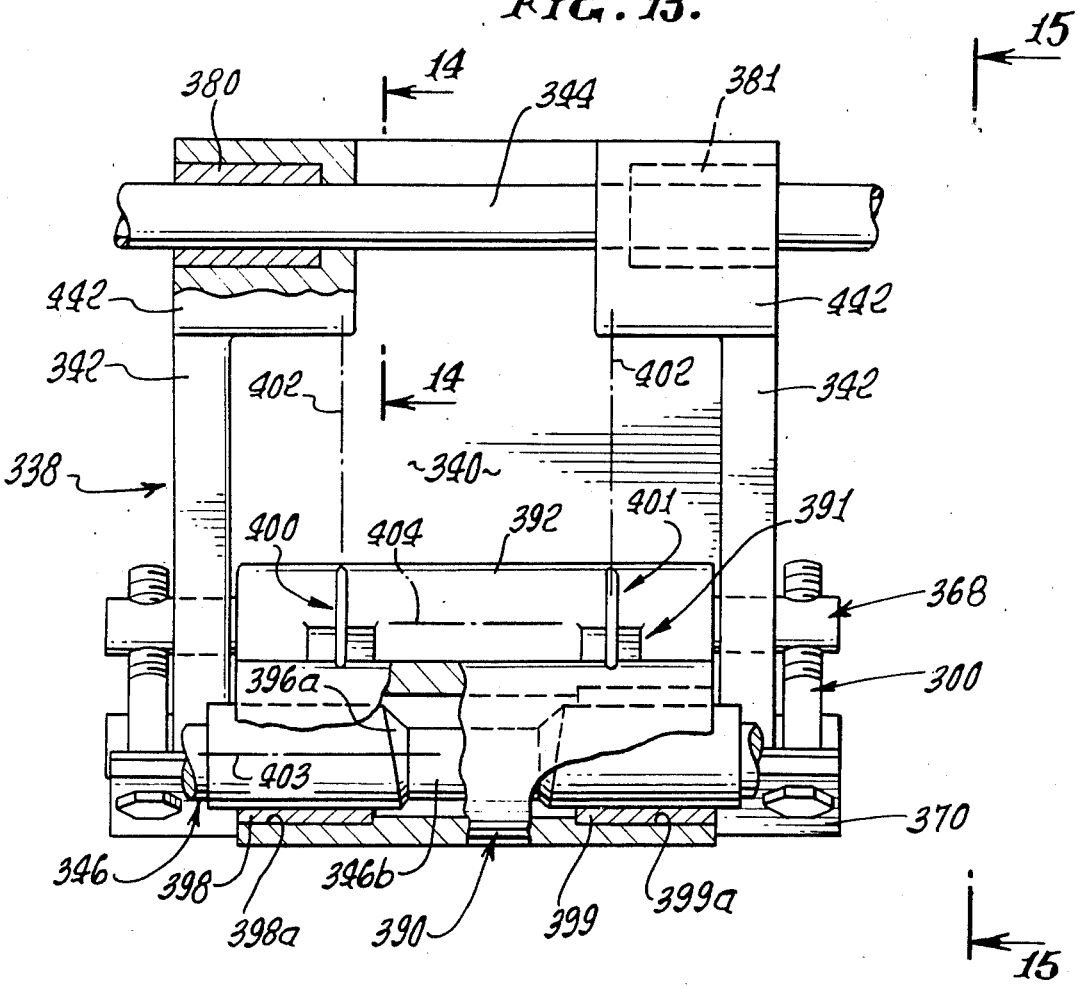
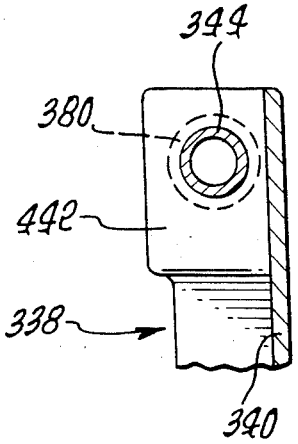
FIG. 14.

OSCILLATED HEAD AND CONNECTING ELEMENT, WITH BEARING SUPPORT, FOR FLOOR STRIPPING MACHINE

BACKGROUND OF THE INVENTION

This invention relates generally to floor stripping devices, and more particularly concerns improvements in the driving and blade support means for same.

U.S. Pat. No. 3,376,071 discloses a floor stripping machine of the type in which the present invention is usable to great advantage. Such machine incorporates a cutting blade carried by a head pivotally mounted to a frame. Problems with machines as disclosed in that patent include failure of rapidly oscillating head driving connecting rods and associated parts and bearings; insufficient lubricating of such rods, parts and bearings, undue wear of the oscillating head at its pivots; unwarranted high cost of repair and replacement of such elements; and difficulty with clamping a blade to the bottom side of the head.

U.S. Pat. Nos. 4,512,611, 4,504,093, 4,483,566, 4,452,492, 4,365,843 and 4,365,842 to applicant disclose improvements over said U.S. Pat. No. 3,376,071.

SUMMARY OF THE INVENTION

It is a major object of the invention to provide an additional solution to the above described problems and disadvantages. Basically, the invention is embodied in:

(a) a connecting element having a first tubular part and a second tubular part, said parts having spaced, parallel axes, said second tubular part pivotally connected to the head, (b) a drive shaft extending within said first tubular part, said shaft operatively connectible to the drive to be rotated thereby, (c) said connecting element including two parallel and spaced legs extending between said first and second tubular parts and integrally merging with the sides thereof at locations spaced from the opposite ends thereof, (d) two annular bearings respectively carried by and within said first tubular part, said bearings respectively receiving two spaced eccentrics to oscillate said first tubular part, said head and said blade as said eccentrics are rotated by the shaft, (e) said head consisting of lightweight metal having two flanges connected by a web, the flanges locally thickened to define two lugs, said legs rotatable in planes intersecting the respective lugs, (f) and bearing bushings received in and carried by said lugs to form bearing openings for a pivot shaft connected to the frame, said bushings being self-lubricated adjacent the shaft.

These and other objects and advantages of the invention, as well as the details of an illustrative embodiment, will be more fully understood from the following specification and drawings, in which:

DRAWING DESCRIPTION

FIG. 13 is an elevation showing details of an improved version;

Figure 15:
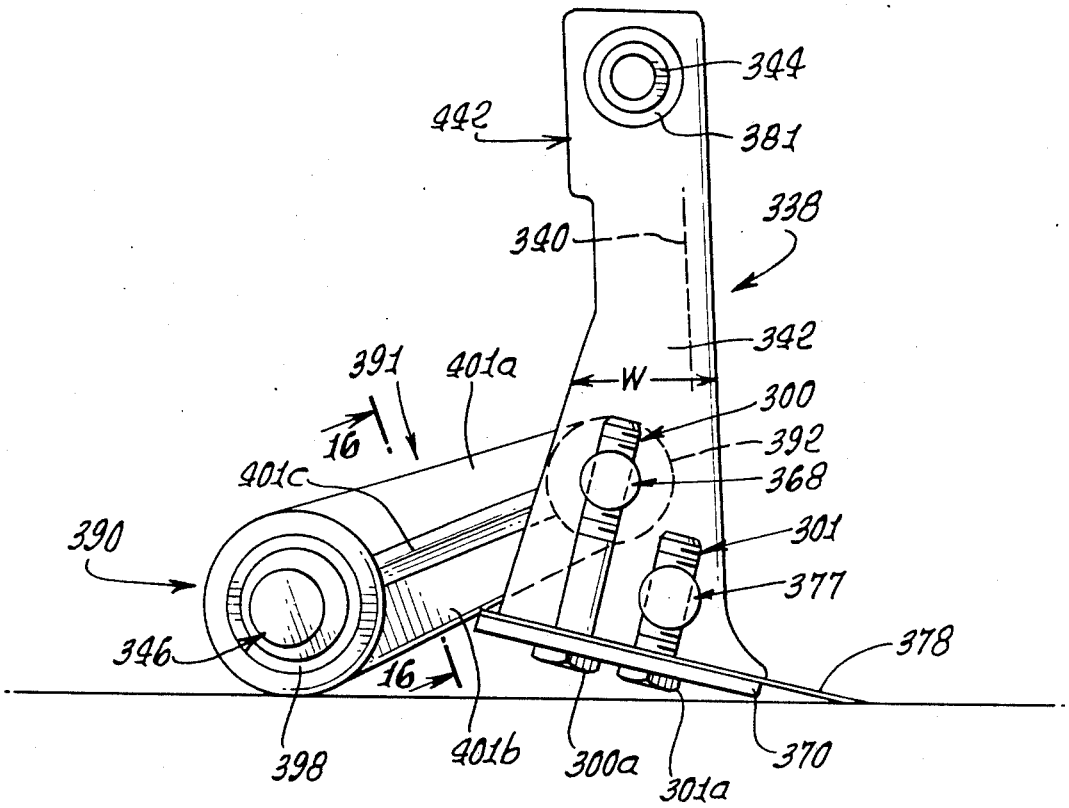
Figure 16:
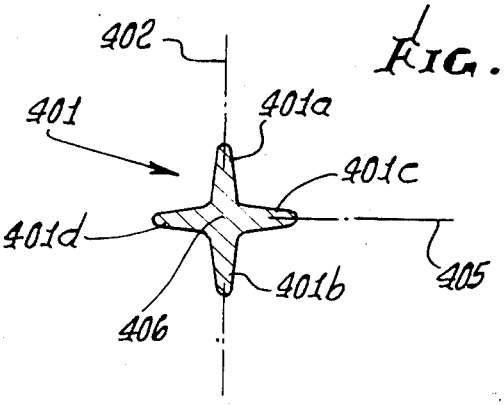

FIGS. 14 and 15 are sections on lines 14—14 and 15—15 of FIG. 13; and FIG. 16 is a section on lines 16—16 of FIG. 15.

DETAILED DESCRIPTION

Figure 1:
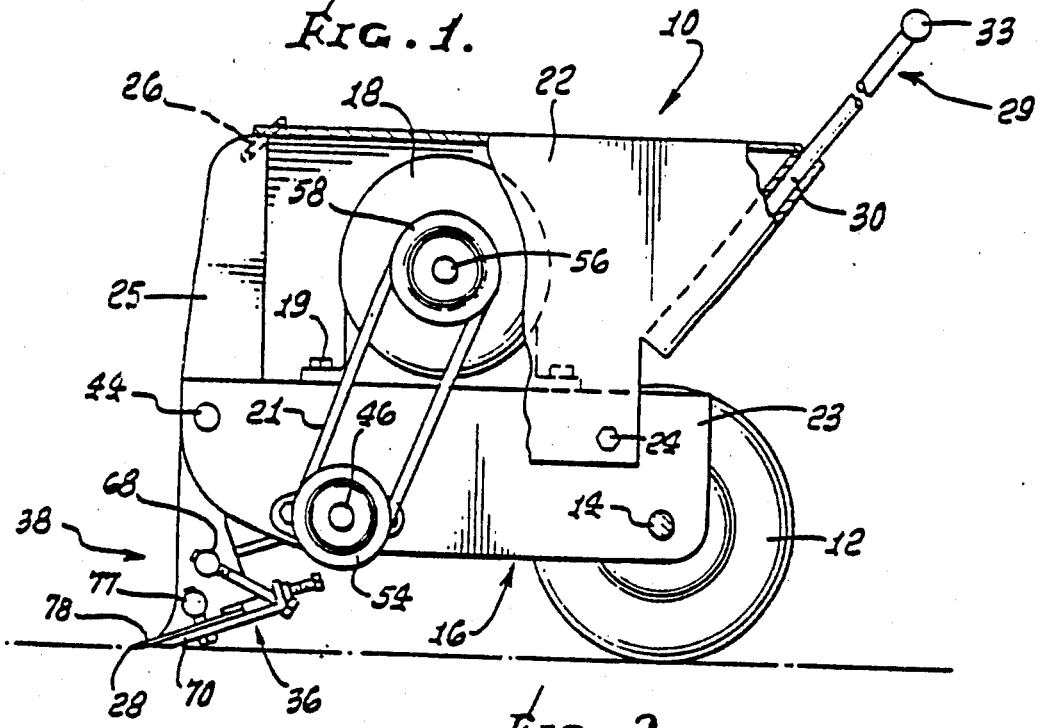
FIG. 1 is a side elevation showing a floor stripping machine incorporating the invention.
Figure 2:
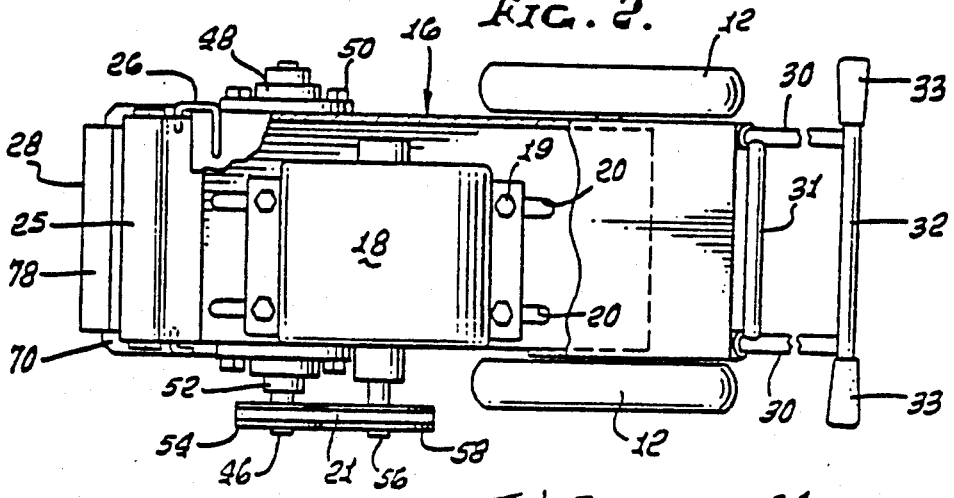
FIG. 2 is a top plan view of the FIG. 1 machine.

Referring now to the drawings and initially, to FIGS. 1 and 2, inclusive, for this purpose, it will be seen that one type of machine in which the invention may be incorporated has been designated in its entirety by reference number 10. Mounted on the machine 10 are a pair of rubber tires 12 which permit the machine 10 to be easily transported and maneuvered. The wheels 12 are carried by an axle 14 which in turn passes through the rear portions of the base frame 16. Mounted on the frame 16 is an electrical motor 18. The machine 10 may alternately be powered by an internal combustion engine. The motor 18 is held in place by four mounting bolts 19 which pass through slots 20 in the frame 16. When the bolts 19 are loosened the motor can be moved forward or backward on the frame 16 by reason of the slots 20 to adjust the tension in the drive belt 21. Covering the motor 18 and attached to the frame 16 is a cover shroud 22. The shroud 22 slides over the side walls 23 of the frame and is held in place by bolts 24 as can be seen in FIG. 1. Positioned on the front of the frame 16 is a nose weight 25. The weight is held in place by means of a releasable wire clip 26 which fastens the forward edge of the shroud 22 with the weight 25. The weight provides the necessary weight on the cutting edge 28 which will later be described.

The handle bar 29 comprises a pair of elongated tubular members 30 which are attached at their lower ends to the shroud 22, and at their upper ends are joined by tubular cross members 31 and 32. Hand grips 33 are used to handle and maneuver the machine 10.

Figure 3:
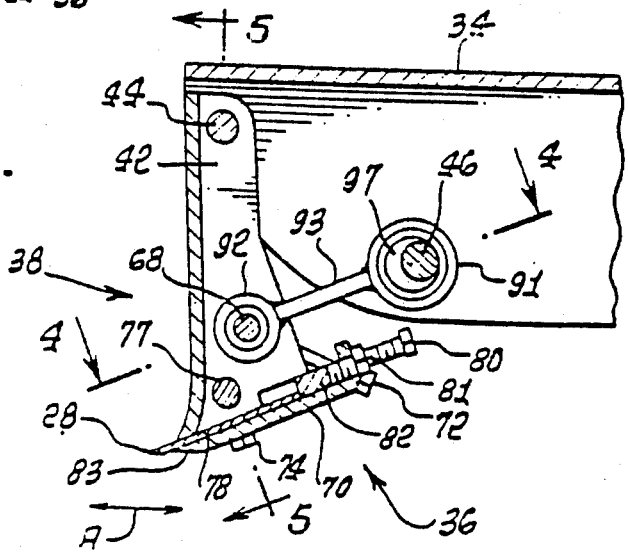
FIG. 3 is an enlarged elevation taken on lines 3—3 of FIG. 4.
Figure 4:
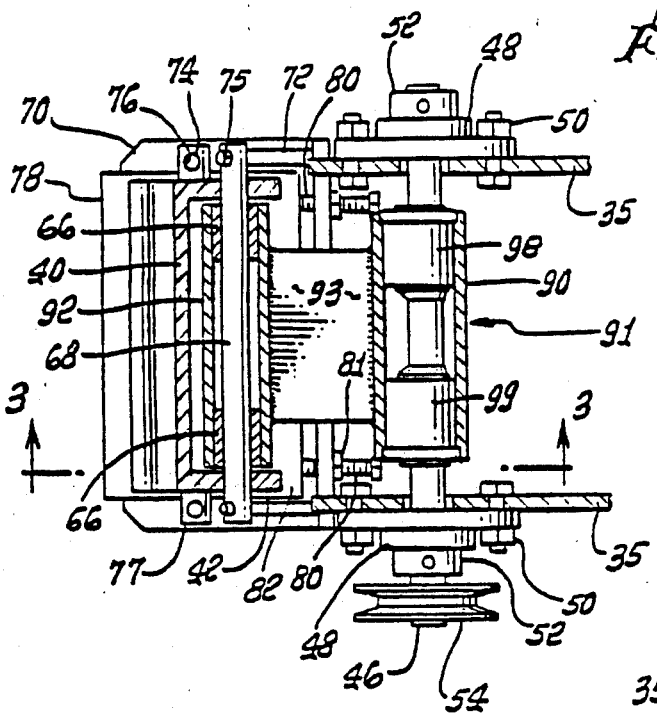
FIG. 4 is a section taken on lines 4—4 of FIG. 3.
Figure 5:
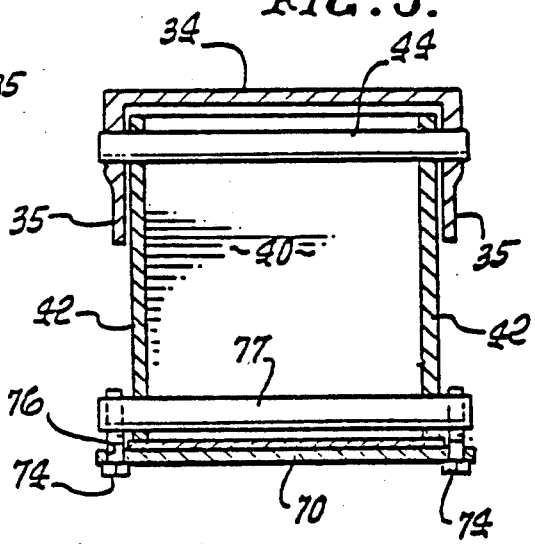
FIG. 5 is a section taken on lines 5—5 of FIG. 3.
Figure 6:
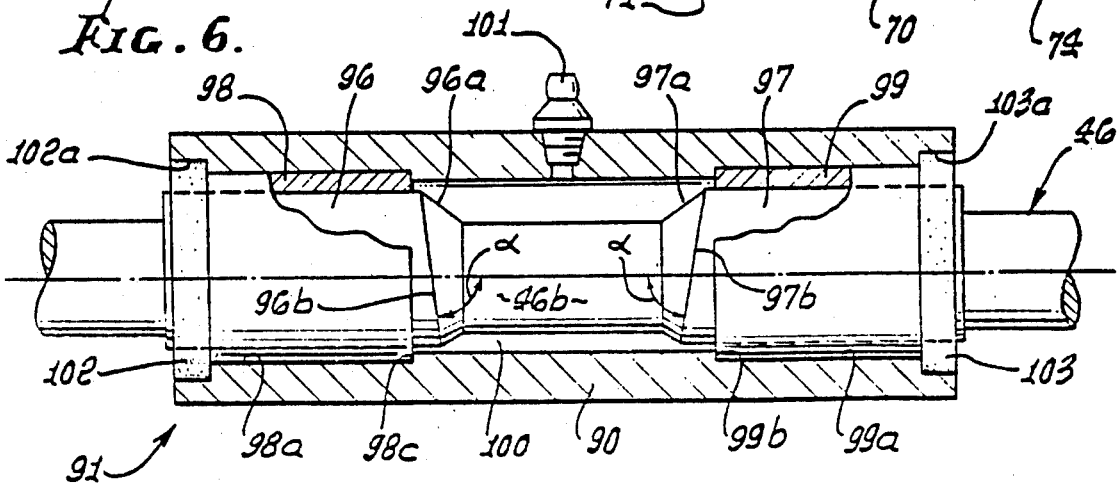
FIG. 6 is an enlarged section taken through connecting structure seen in FIG. 4.

FIGS. 3 through 5 show the cutter head subassembly 36 in detail. The frame 16 previously mentioned is substantially U-shaped with a horizontal web portion 34 and a pair of vertical flanges 35 as can best be seen in FIG. 5. At the forward end of the frame 16 positioned between the webs 35 is the cutting head 38. The head 38 is formed with a web 40 and a pair of flanges 42. The cutting head is pivotally mounted at the upper end to the frame 16 by a pin 44 which passes through both pairs of flanges 35 and 42. Passing through the pair of flanges 35 and journalled thereto is a rotatably mounted drive shaft 46 which is shown in FIGS. 4 and 6. The shaft 46 is journalled at its outer ends in a pair of roller bearings 48 which are in turn bolted to the frame flanges 35 by means of bolts 50. Retaining the cam shaft in the bearings 48 are pair of locking sleeves 52 which are mounted on the shaft 46 immediately outward of the bearings 48. Keyed to one end of the shaft 46 is a sheave 54 adapted to carry a V-belt. Mounted on the shaft 56 of the motor 18 is a similar sheave 58 which lies in the same plane of rotation as sheave 54. The two sheaves 54 and 58 are connected by means of a rubber V-belt 21. The tension in the V-belt 21 may be adjusted as previously discussed.

Figure 7:
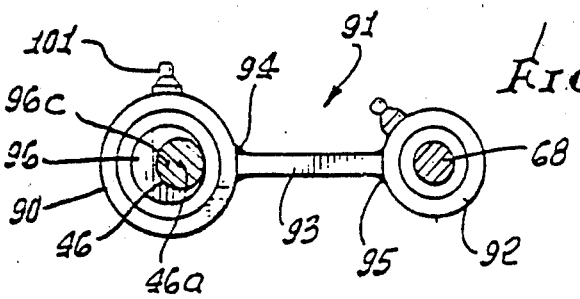
Fig. 7 is an end elevation view of the FIG. 6 connecting structure.

The shaft 46 extends within a first tubular part 90 of a connecting element 91, the latter also incorporating a second and smaller diameter tubular part 92. As disclosed in my prior patents, those tubular parts comprised steel interconnected by a steel plate 93 welded to outer side portions of the sections, as at 94 and 95. See FIG. 7. That construction has became disadvantageous, including assembly difficulty.

Shaft 46 carries two axially spaced eccentrics 96 and 97. See in FIG. 7 the axis 96*c* of eccentric 96 offset from the axis 46*a* of shaft 46. Each eccentric is cylindrical to rotate within a bearing, such as a bushing, the two bushings indicated at 98 and 99 and received in counterbores 98*a* and 99*a* in the pipe section, and against step shoulders 98*b* and 99*b*. The large space 100 thus provided between the eccentrics provides a lubricant (grease) reservoir, for long lasting lubrication of the two bearings, as the shaft rotates and on the eccentrics oscillate the shaft section 90, and the element 91 back and forth, as will be described. Shaft section 46*b* extends between and interconnects the two eccentrics.

Note that the eccentrics have oppositely facing end portions or faces 96*a* and 97*a*, which, due to their flaring eccentricity, tend to positively displace the grease as the eccentrics rotate. This serves to urge grease radially outwardly, and axially toward the bushings and the bearing surfaces of the eccentrics and bushings, for enhancement of lubrication. Note that faces 96*a* and 97*a* intersect the outer surfaces of the eccentrics in planes 96*b* and 97*b* that are at angles $\alpha$ relative to the shaft axis, angles $\alpha$ being less than 90°. Grease is introduced to space 100 via a grease fitting 101 in shaft 90, as shown.

Annular elastomeric seals 102 and 103 are located at opposite ends of the bushings, and pressed into the shaft counterbores 102*a* and 103*a*, as shown. Those seals exert pressure on the shaft eccentrics to prevent escape of grease.

At the opposite end of element 91 is a bearing shaft 68 journaled via bushings 66 to the pipe section 92. Shaft 68 is in turn mounted to cutting head 38. When shaft 56 is rotated, element 91 is oscillated back and forth to cause head 38 to move back and forth about the axis of pipe 44, as indicated by arrows in FIG. 3.

At the lower extremities of the cutting head 38 the flanges 42 become wider to accomodate the cutting blade shoe 70. The shoe 70 is adjustably held against the cutting head by two pairs of bolts 72 and 74. The bolts 72 pass through openings 75 in the rear of the blade shoe 70 and are threaded into the ends of the connecting rod shaft 58. The bolts 74 pass through openings 76 and are threaded into the ends of shaft 77. The purpose of the blade shoe 70 is to rigidly hold the cutting blade 78 in its cutting position. Located on the back edge of the blade shoe 70 are a pair of adjusting bolts 80 and locking nuts 81 which allow for adjustment of the position of the blade stop 82 which in turn adjusts the amount of blade edge exposure. The front edge 83 of the blade shoe 70 is tapered to provide a maximum amount of rigidity to the cutting blade and yet permit a shallow angle of slope between the cutting blade 78 and the flooring surface being stripped.

Figure 8:
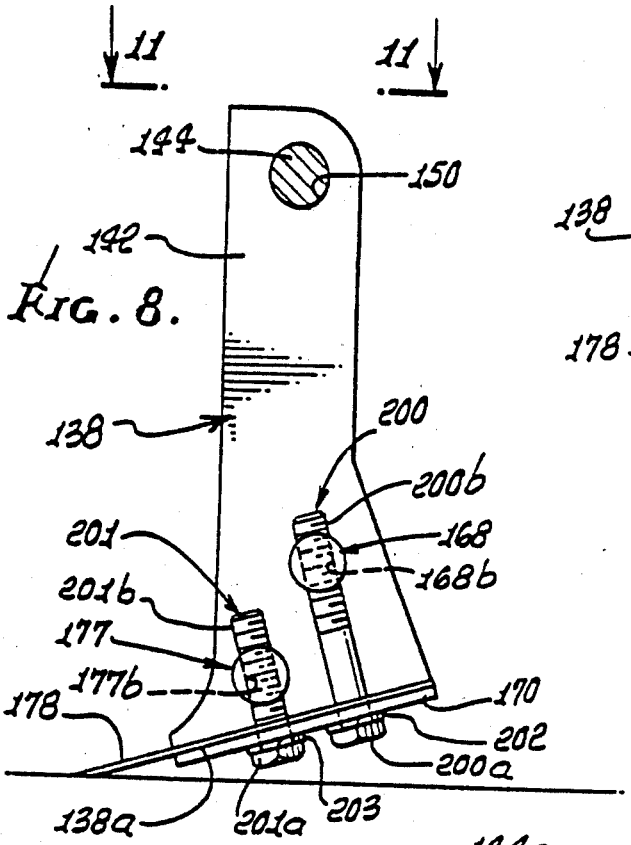
FIG. 8 is a side elevation.
Figure 10:
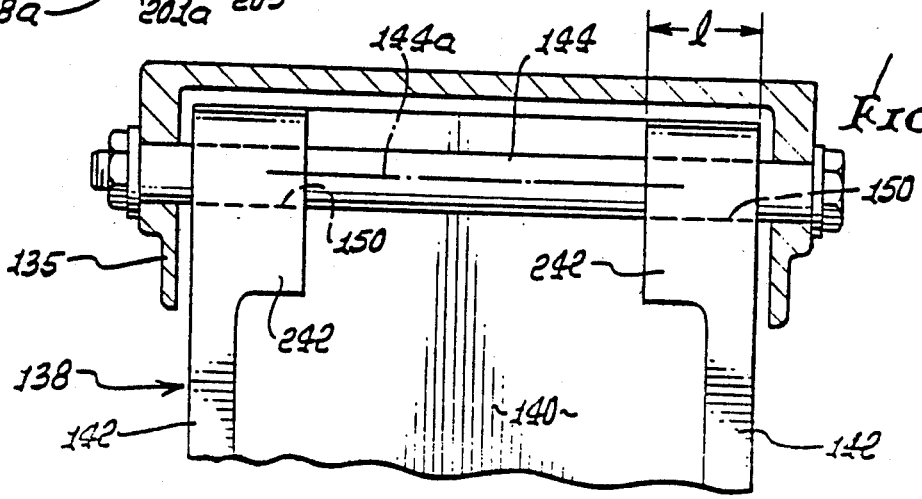
FIG. 10 is a fragmentary front elevation, showing the head of FIG. 8.
Figure 11:
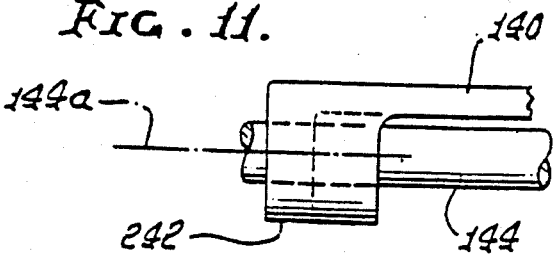
FIG. 11 is a fragmentary plan view on lines 11—11 of FIG. 8, and FIG. **11*a* is a view like FIG. 11**.

FIGS. 8, 10 and 11 show a modified head 138 consisting of lightweight metal such as aluminum, or aluminum alloys, or magnesium, or magnesium alloys. The head has two elongated flanges 142 interconnected by a web 140. The flanges are locally thickened near upper ends of the flanges to define two widened lugs 242 that form widened bearing openings 150 for a pivot shaft 144. The latter is connected to the frame flanges 135 (corresponding to flanges 35 in FIG. 5). The bearing openings (and the lugs) have lengths "l" in excess of $\frac{3}{4}$ inch, and preferably are between $\frac{3}{4}$ and $1\frac{1}{2}$ inches in length. As a result, destructive wear of the head metal surrounding the openings 150 is eliminated, and in particular for heavy duty operation where stripping forces are extensive.

Figure 11A:
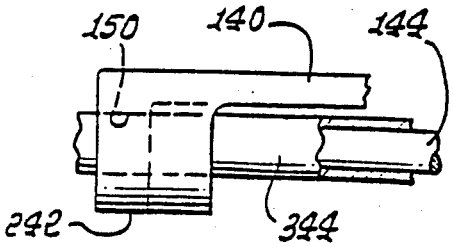

The openings are sized to closely receive the pivot shaft 144, and define a common axis 144*a*. FIG. 11*a* shows modification, with a steel tube 344 received in openings 150, and in turn receiving the shaft 144. Tube 344 helps distribute loading to insure against destructive wear of the lightweight metal lugs 242.

Figure 9:
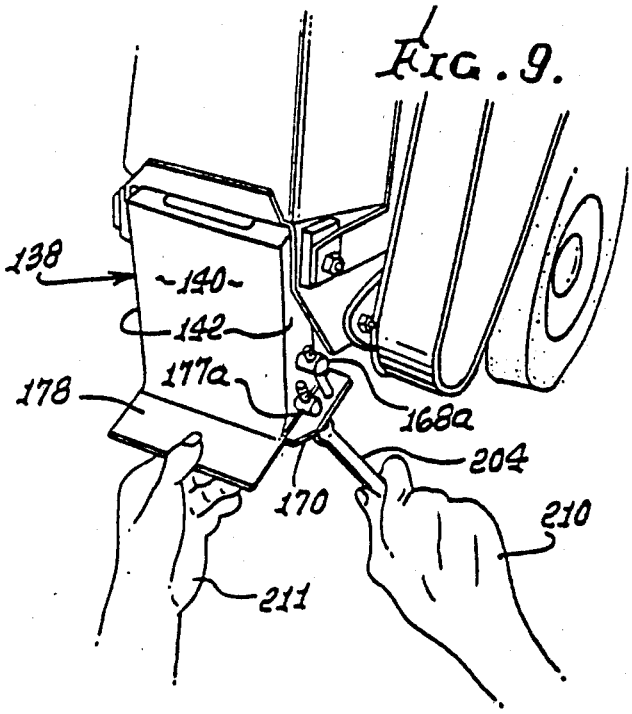
FIG. 9 is a perspective view.

FIGS. 8 and 9 also show the use of the modified blade holder plate 170 attached to the head 138 at its bottom side 138*a*. Blade 178 is clamped against that side, by the plate. Two shafts, 177 and 168 extend parallel to the web 140 and through flanges 142 to provide shaft projections 177*a* and 168*a* at the exterior side of each flange. Two pairs of fasteners 200 and 201 extend in parallel relation through suitable openings in the holder plate and in the blade, at opposite ends of the shafts, respectively. The fasteners have heads 200*a* and 201*a* that clamp split washers 202 and 203 against the bottom of the holder plate. Also, the fasteners have threaded shanks 200*b* and 201*b* received in threaded engagement with threaded openings 177*b* and 168*b* in the shaft projections 177*a* and 168*a*. Accordingly, tightening of the blade in position as shown in FIG. 9 may be accomplished using one hand 210 only, i.e. by manipulation of the wrench 204 in grip engagement with the fastener heads, and the blade may be held and positioned by the other hand 211.

The operation of the stripping machine 10 varies with the type of floor being removed. The steeper the angle of the blade 78 with the floor the deeper the blade will dig. The angle can be varied by lifting the wheels 12 off the floor. The angle can also be varied by extending the blade 78 further past the edge of the shoe 70. When removing a plywood or particle board floor an extra long blade which extends an additional four inches or more past the edge of the shoe 70 has proven very useful. The longer the blade 78 is extended out of the shoe the less the angle between the cutting blade and floor. The amount of weight applied to the cutting edge 28 is also variable depending upon the flooring being removed. The weight can be varied by the amount of pressure applied by the hands to the handle bar 29. Generally, the machine best operates when the handle bar 29 is lifted up until the wheels are one-half inch off the floor. When an exceptionally tough flooring is being removed, a blade with teeth formed on the cutting edge has been found to be very effective.

Figure 12:
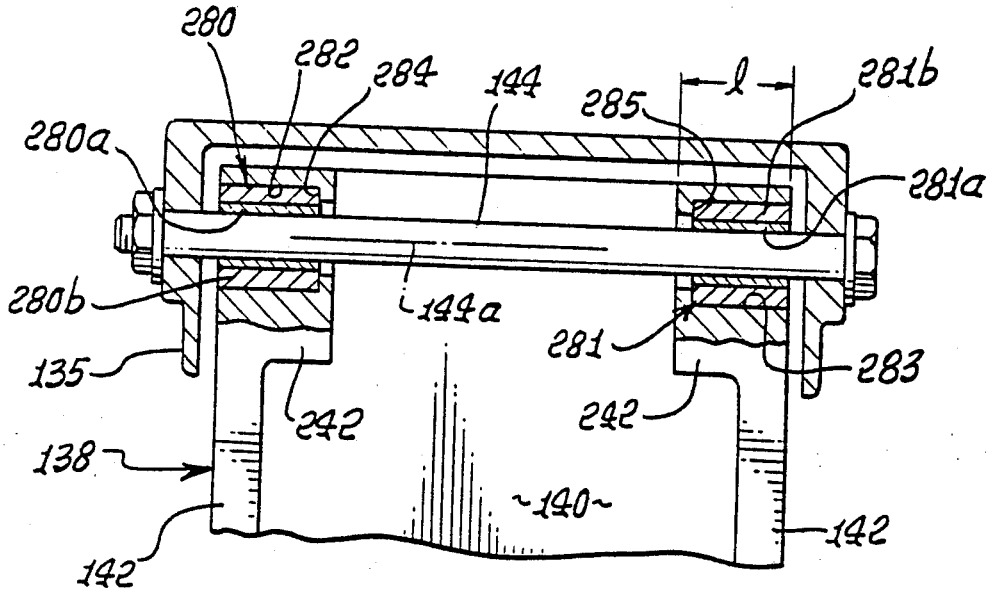
FIG. 12 is a view like FIG. 10, but showing a modification.

FIG. 12 is a view like FIG. 10, with corresponding elements having the same identifying numbers. It differs from FIG. 10 in the provision of bushings 280 and 281 fitted and retained in bores 282 and 283 in lugs 242. The bushings may endwise fit against stop shoulders 284 and 285 in the lugs. The bushings may advantageously be self-lubricated, as provided by annular material 280*a* and 281*a* carried in metallic (as for example bronze) sleeves 280*b* and 281*b* press-fitted in bores 282 and 283. Material 280*a* and 281*a* may for example consist of molybdenum disulfide. One example of such bushings are known "OILITE" bushings.

Pivot shaft 144 (typically steel) is received in, and has low friction running fit in, the bores of the annuli 280*a* and 281*a*, for long lasting, low wear operation.

FIGS. 13–16 show an improved form of the head 338 and connector 391. (Elements corresponding to those of FIGS. 1–11 have the same numbers, with a "3" preceding each number).

Connector 391 is a casting made of lightweight metal such as zinc or aluminum, and has first and second tubular parts 390 and 392, the outer diameter of part 390 for example being about $1\frac{5}{8}$ inches, and that of part 392 being about $1\frac{1}{4}$ inches. Self lubricated bushings or bearings 398 and 399 are press fitted into bores 398*a* and 399*a* of part 390. Shaft 346 is as decribed before, and as shown in FIG. 6, where it bears number 46.

The connector 391 also includes two legs 400 and 401 which extend substantially parallel between tubular parts 390 and 392 and merge therewith, at the opposite ends of the legs, at locations spaced from the opposite ends of the tubular parts 390 and 392. The legs have first webs 401*a* and 401*b* which define planes 402 normal to parallel axes 403 and 404 defined by parts 390 and 392. Those planes also intersect the enlarged, heavy duty lugs 442 integral with head 338, for maximum strength.

The legs also have second webs 401*c* and 401*d* defining planes 405 normal to planes 402, and parallel to spaced parallel axes 403 and 404. Second webs 401*c* and 401*d* merge with the tubular parts or elements 390 and 392 along the sides thereof facing one another, as shown. Webs 401*a* and 401*b* intersect webs 401*c* and 401*d* at mid-region 406 (see FIG. 16), and all four webs taper outwardly, away from that region, as shown to form a cross. Accordingly, a high strength, low weight, connection of parts 390 and 391 is formed, utilizing a light-weight, unitary metal casting. Mid-region 406 is enlarged, for added strength, and webs 401*a*–401*d* maximally resist relative bending of parts 390 and 392.

The flanges 342 have widths "w" that increase in dimension in direction toward the plate 370 and blade 378, as shown in FIG. 15, and the tubular part 392 is confined between those flanges, with the webs 401*a*–401*d* merging with part 392 between the flanges of increased width near plate 370.

Self-lubricated bushings are employed at 380 and 381, in the two lugs 342, to receive tubular shaft 344. "OILITE" bushings may be used for this purpose.

The head 338 may also consist of the same lightweight metal as connector 390, whereby a very lightweight assembly is provided for minimum vibration transmission to the user.

I claim:

1. For use in power-operated floor stripping apparatus that includes a frame, a drive carried on the frame, wheels supporting the frame, a handle to guide the frame, and a cutting blade carried by a head which is pivotally mounted to the frame, the improvement comprising (a) a connecting element having a first tubular part and a second tubular part, said parts having spaced parallel axes, one tubular part having an outside diameter substantially larger than the outside diameter of the other tubular part, (b) a drive shaft extending within said first tubular part, said shaft operatively connectible to the drive to be rotated thereby, (c) said drive shaft carrying two axially spaced eccentrics to be rotated by the shaft, there being a lubricant receiving space located directly between said eccentrics, (d) two annular bearings respectively carried by and within said first tubular part, said bearings respectively receiving said spaced eccentrics to oscillate said first tubular part, said head and said blade as said eccentrics are rotated by the shaft, (e) said head consisting of lightweight metal and having two flanges interconnecting by a web, the flanges being locally thickened to substantial extent to define two lugs, (f) said second tubular part extending between said flanges and pivotally connected thereto in spaced relation to said lugs, (g) said connecting element including two substantially parallel legs extending between said first and second tubular parts and integrally merging therewith at locations spaced from the ends of said parts, (h) said legs having first webs defining planes normal to parallel axes defined by said parts, said planes defined by the webs intersecting said lugs, the webs having outer edges tangent to the outer surfaces of the tubular parts whereby said outer edges taper toward the smaller diameter part, (i) second webs normal to said first webs, and defining planes parallel to said spaced parallel axes defined by said parts, said second webs also merging with said parts, said first and second webs extending in intersecting relation at an enlarged central region of each leg, (j) said planes defined by the first webs also intersecting said eccentrics so that said lubricant receiving space is centered between said planes.

2. The improvement of claim 1 wherein said planes defined by the webs intersect said lugs proximate inner edges defined by the lugs.

3. The improvement of claim 1 including bearing bushings received in and carried by said lugs to form bearing openings for a pivot shaft connected to the frame, said bushings being self-lubricated adjacent the shaft.

4. The improvement of claim 3 wherein said lugs have lengths between $\frac{3}{4}$ and $1\frac{1}{2}$ inches.

5. The improvement of claim 4 including said pivot shaft closely received in said bearing openings.

6. The improvement of claim 1 including a blade holder plate attached to the head at the bottom side thereof, said flanges having width that increase in direction toward said plate, two shafts extending parallel to said head web and through said head flanges to provide shaft projections exteriorly of said flanges, and fasteners extending through said holder plate and having threaded shanks in threaded engagement with threaded openings in said shaft projections, the fasteners having heads below said holder plate to be rotated for clamping the blade between the plate and the head bottom side, said legs merging with said second tubular part at locations proximate the increasing width of said flanges.

7. The improvement of claim 6 including said frame, drive, wheels, handle and cutting blade clamped to said holder plate.

8. The improvement of claim 1 wherein said first and second tubular parts and said legs are defined by a lightweight metal casting.

9. The improvement of claim 8 wherein said metal casting consists of metal selected from the group consisting essentially of zinc, aluminum and magnesium.

10. The combination of claim 1 wherein said eccentrics have oppositely facing end faces which flare radially outwardly and axially away from said space, to urge and guide lubricant toward said bearings.

11. The combination of claim 10 wherein said bearings comprise bushings.

12. The combination of claim 10 wherein said end faces intersect the outer cylindrical surfaces of the eccentrics in planes extending at angles $\alpha$ relative to the shaft axis, said angles $\alpha$ being less than 90.

* * * * *